United States Patent [19]

Donomoto

[11] Patent Number: 4,802,524

[45] Date of Patent: Feb. 7, 1989

[54] METHOD FOR MAKING COMPOSITE MATERIAL USING OXYGEN

[75] Inventor: Tadashi Donomoto, Toyota, Japan

[73] Assignee: Toyota Jidosha Kabushiki Kaisha, Japan

[21] Appl. No.: 581,226

[22] Filed: Feb. 23, 1984

Related U.S. Application Data

[63] Continuation of Ser. No. 282,185, Jul. 15, 1981, abandoned.

[30] Foreign Application Priority Data

Jul. 30, 1980 [JP] Japan ..... 55-105654

[51] Int. Cl.[4] ..... B22D 19/14

[52] U.S. Cl. ..... 164/97; 164/100; 164/122.1

[58] Field of Search ..... 164/55.1, 56.1, 57.1, 164/97-100, 108, 119-122.1; 228/217

[56] References Cited

U.S. PATENT DOCUMENTS

| | | | |
|---|---|---|---|
| 3,268,960 | 8/1966 | Morton | 164/305 X |
| 3,364,976 | 1/1968 | Reding et al. | 164/98 |
| 3,378,914 | 4/1968 | Miller | 228/217 X |
| 3,396,777 | 8/1968 | Reding | 164/97 |
| 3,433,291 | 3/1969 | Hodler | 164/305 |
| 3,547,180 | 12/1970 | Cochran | 164/97 X |
| 3,695,335 | 10/1972 | Cannell et al. | 164/97 |
| 3,779,304 | 12/1973 | Miki | 164/55.1 X |
| 3,828,839 | 8/1974 | Dhingra | 164/97 |
| 3,853,635 | 12/1974 | Demendi | 164/97 X |
| 4,266,596 | 5/1981 | Ban et al. | 164/97 |
| 4,279,289 | 7/1981 | Ban et al. | 164/120 |
| 4,292,725 | 10/1981 | Larsson et al. | 228/217 X |

FOREIGN PATENT DOCUMENTS

| | | | |
|---|---|---|---|
| 39229 | 11/1971 | Japan | 164/63 |
| 154374 | 1/1963 | U.S.S.R. | 164/56.1 |
| 443717 | 5/1975 | U.S.S.R. | 164/61 |
| 526445 | 9/1976 | U.S.S.R. | 164/97 |

*Primary Examiner*—Richard K. Seidel

*Attorney, Agent, or Firm*—Stevens, Davis, Miller & Mosher

[57] ABSTRACT

A method for making a composite material. Porous reinforcing material such as fiber material is charged into a container which has an opening; then substantially all of the atmospheric air in the container and in the interstices of the reinforcing material is replaced by substantially pure oxygen; and then molten matrix metal is admitted into the container through the opening so as to infiltrate into the interstices of the reinforcing material. During this infiltration the oxygen within the container and in these interstices is absorbed by an oxidization reaction, and thus substantially all the gas present within the interstices of the reinforcing material is disposed of, thus not hampering the good infiltration of the molten matrix metal into the reinforcing material. Thus a high quality composite material is formed. The oxidization reaction may either be with the molten matrix metal itself, or with a getter element provided within the container.

6 Claims, 1 Drawing Sheet

METHOD FOR MAKING COMPOSITE MATERIAL USING OXYGEN

This application is a continuation, of application Ser. No. 282,185, filed July 10, 1981, now abandoned.

BACKGROUND OF THE INVENTION

The present invention relates to a method for producing composite material, and, more particularly, relates to method for producing composite material composed of a reinforcing material such as fiber, wire, powder, short staple fiber, or the like embedded within a matrix of metal.

There are known various types of reinforced materials, in which powder, short staple fibers, or fibers of a reinforcing material such as metal, alumina, boron, carbon, or the like are embedded within a matrix of metal such as aluminum or magnesium or the like to form a composite material, and various methods of production for such composite or reinforced material have already been proposed.

One such known method for producing such fiber reinforced material is called the diffusion adhesion method, or the hot press method. In this method, a number of sheets are made of fiber and matrix metal by spraying molten matrix metal onto sheets or mats of fiber in a vacuum; and then these sheets are overlaid together, again in a vacuum, and are pressed together at high temperature so that they stick together by the matrix metal diffusing between them. This method has the disadvantage of requiring complicated manipulations to be undertaken in the inside of a vacuum device of a large size. This is clumsy, difficult, and expensive, and accordingly this diffusion adhesion method is unsuitable for mass production, due to high production cost and production time involved therein.

Another known method for producing such fiber reinforced material is called the infiltration soaking method, or the autoclave method. In this method, fiber is filled into a container, the fiber filled container is then evacuated of atmosphere, and then molten matrix metal is admitted into the container under pressure, so that this molten matrix metal infiltrates into the fiber within the container. This method, also, requires the use of a vacuum device for producing a vacuum, in order to provide good contact between the matrix metal and the reinforcing material at their interface, without interference caused by atmospheric air trapped in the interstices of the fiber mass. Further, this autoclave method also has the additional disadvantage that, if the molten matrix metal is magnesium, it is difficult to attain the required proper high degree of vacuum, due to the high vapor pressure of molten magnesium.

SUMMARY OF THE INVENTION

Accordingly, it is the primary object of the present invention to provide a method for making a composite material of porous reinforcing material and matrix metal, in which no vacuum device is required.

It is a further object of the present invention to provide such a method for making a composite material of porous reinforcing material and matrix metal, using no vacuum device, in which the matrix metal is smoothly and properly infiltrated into the porous structure of the reinforcing material.

It is a further object of the present invention to provide such a method for making a composite material of porous reinforcing material and matrix metal, using no vacuum device, in which air which is initially present in the porous structure of the reinforcing material is efficiently evacuated therefrom.

It is a further object of the present invention to provide such a method for making a composite material of porous reinforcing material and matrix metal, using no vacuum device, in which it does not occur that gas present in the porous structure of the reinforcing material interferes with the infiltration of the molten matrix metal thereinto.

It is a further object of the present invention to provide such a method for making a composite material of porous reinforcing material and matrix metal, using no vacuum device, in which close contact between the reinforcing material and the matrix metal is obtained.

It is a further object of the present invention to provide such a method for making a composite material of porous reinforcing material and matrix metal, using no vacuum device, in which the air originally permeating the porous structure of said reinforcing material is replaced by oxygen, and in which said replacement by oxygen is performed smoothly and efficiently.

It is a further object of the present invention to provide such a method for making a composite material of porous reinforcing material and matrix metal, using no vacuum device, in which the composite material includes a multitude of fibers, and in which the orientation of these fibers is arranged to cooperate with said replacement by oxygen of the air originally permeating the porous structure of said reinforcing material.

It is a further object of the present invention to provide such a method for making a composite material of porous reinforcing material and matrix metal, using no vacuum device, in which the molten matrix metal is positively sucked into and through the interstices of the reinforcing material.

It is a further object of the present invention to provide such a method for making a composite material of porous reinforcing material and matrix metal, using no vacuum device, in which the air originally permeating the porous structure of said reinforcing material is replaced by oxygen, and in which said oxygen later is removed by an oxidization reaction.

It is a further object of the present invention to provide such a method for making a composite material of porous reinforcing material and matrix metal, using no vacuum device, in which the air originally permeating the porous structure of said reinforcing material is replaced by oxygen, and in which said oxygen later is removed by an oxidization reaction with the matrix metal.

It is a further object of the present invention to provide such a method for making a composite material of porous reinforcing material and matrix metal, using no vacuum device, in which the air originally permeating the porous structure of said reinforcing material is replaced by oxygen, and in which said oxygen later is removed by an oxidization reaction with a getter element provided for this purpose.

It is a further object of the present invention to provide such a method for making a composite material of porous reinforcing material and matrix metal, using no vacuum device, in which the solidification of the composite material, after molten matrix metal has been infiltrated into the porous structure of the reinforcing material, is performed in a way which promotes good properties for the resulting composite material.

It is a yet further object of the present invention to provide such a method for making a composite material of porous reinforcing material and matrix metal, using no vacuum device, in which the air originally permeating the porous structure of said reinforcing material is replaced by oxygen and in which said oxygen later is removed by an oxidization reaction, in which no substantial risk exists of said oxygen reacting with said reinforcing material to such an extent as to damage said reinforcing material.

It is a yet further object of the present invention to provide such a method for making a composite material of porous reinforcing material and matrix metal, using no vacuum device, in which no pressure greater than atmospheric is required.

It is a yet further object of the present invention to provide such a method for making a composite material of porous reinforcing material and matrix metal, using no vacuum device, in which the problem of poor wettability of the reinforcing material by the matrix metal is solved by the application of a moderate degree of pressure.

It is a yet further object of the present invention to provide such a method for making a composite material of porous reinforcing material and matrix metal, using no vacuum device, in which a proper material for the reinforcing material is selected.

It is a yet further object of the present invention to provide such a method for making a composite material of porous reinforcing material and matrix metal, using no vacuum device, in which a proper material for the matrix metal is selected.

It is a yet further object of the present invention to provide such a method for making a composite material of porous reinforcing material and matrix metal, using no vacuum device, in which the air originally permeating the porous structure of said reinforcing material is replaced by oxygen, in which said oxygen later is removed by an oxidization reaction with a getter element provided for this purpose, and in which a proper material for the getter element is selected.

According to the present invention, these and other objects are accomplished by a method for making a composite material, comprising the steps, performed in the specified sequence, of: (a) charging porous reinforcing material into a container which has an opening portion; (b) replacing substantially all of the atmospheric air in said container and in the interstices of said reinforcing material by substantially pure oxygen; and (c) admitting molten metal into said container through said opening portion thereof to infiltrate into said interstices of said reinforcing material; (d) said oxygen admitted during step (b) to within said container being, during step (c), substantially completely absorbed by an oxidization reaction.

According to such a procedure, substantially all the gas present within the interstices of said reinforcing material, during step (c), is disposed of by said oxidization reaction, thus not hampering the good infiltration of said molten metal into said reinforcing material; whereby a high quality composite material is formed.

Further, according to a particular aspect of the present invention, these and other objects are more particularly and concretely accomplished by a method as described above, wherein a vacant space is left within said container, during step (a), at a position therein on the opposite side of said reinforcing material charged in said container from the opening portion of said container, said vacant space not being directly communicated with the outside of said container.

According to such a procedure, the suction produced by the oxygen present within said vacant space being absorbed by oxidization, during step (c), positively sucks molten metal through the interstices of said reinforcing material from said opening portion of said container towards said vacant space.

Further, according to two alternative aspects of the present invention, these and other objects may be accomplished by such a method as those described above, in which said oxygen admitted during step (b) to within said container is, during step (c), absorbed by an oxidization reaction with said matrix metal; or, alternatively, said oxygen admitted during step (b) to within said container is, during step (c), absorbed by an oxidization reaction with a getter element provided within said container.

Further, according to a more particular aspect of the present invention, these and other objects are more particularly and concretely accomplished by a method such as any of those described above, wherein the oxidization reaction by which said oxygen is absorbed is an oxidization reaction with a substance which has a substantially greater affinity for oxygen than does said reinforcing material.

According to such a procedure, no substantial risk exists of said oxygen reacting with said reinforcing material to such an extent as to damage said reinforcing material.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The present invention will now be described with reference to several preferred embodiments thereof, and with reference to the appended drawings.

THE FIRST EMBODIMENT

Figure 1:
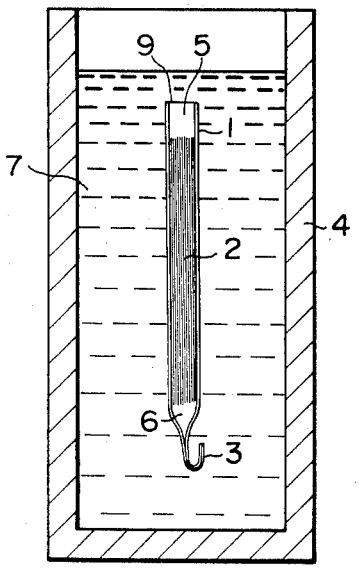
FIG. 1 is a sectional view, showing a section of a casting mold filled with molten matrix metal, and a section of a case filled with reinforcing material submerged in said molten matrix metal, during the practicing of a first preferred embodiment of the method according to the present invention.

FIG. 1 is a sectional view, showing elements involved in the practicing of a first preferred embodiment of the method according to the present invention. The production of fiber reinforced material, in this first preferred embodiment, is carried out as follows.

A tubular stainless steel pipe designated by the reference numeral 1, which initially is open at both ends, which is formed of stainless steel of JIS (Japanese Industrial Standard) SUS310S, and which is 8 mm in diameter and 100 mm long, is charged with a bundle 2 of alumina fiber (which may be FP alumina fiber made by Dupont) 80 mm long, the fibers of said alumina fiber bundle 2 being all aligned with substantially the same fiber orientation and being 20 microns in diameter, in such a way that vacant spaces 5 and 6 within the stainless steel pipe 1 are left between its open ends and the bundle of alumina fiber 2. The alumina fiber bundle 2 is squeezed by such an amount that its volume ratio is approximately 55%; i.e., so that the proportion of the total volume of the alumina fiber bundle 2 actually occupied by alumina fiber is approximately 55%, the rest of this volume being of course at this initial stage occupied by atmospheric air. Further, in the shown first preferred embodiment of the method according to the present invention, the orientation of the fibers of the alumina fiber bundle 2 is along the central axis of the stainless steel tube 1.

Next, oxygen is blown into one end of this charged stainless steel pipe 1, and gas is exhausted from the other end thereof. Thus, of course, initially the exhausted gas will be atmospheric air, and subsequently the exhausted gas will be a mixture of atmospheric air and oxygen; but, as the oxygen being blown in at said one end of the stainless steel pipe 1 progressively displaces the atmospheric air within the vacant spaces 5 and 6 at the opposite ends of the fiber bundle 2, and percolates along between the alumina fibers of the alumina fiber bundle 2 and displaces the atmospheric air present therebetween, the gas which is exhausted from said other end of the stainless steel pipe 1 progressively to a greater and greater extent will become composed of pure oxygen. When this exhausted gas comes to be composed of substantially pure oxygen, i.e. when substantially all of the atmospheric air has been displaced from the vacant spaces 5 and 6 and more importantly substantially all of the atmospheric air has been displaced from between the alumina fibers of the alumina fiber bundle 2, then one end 3 of the stainless steel tube 1 is sealed shut, for example by tightly turning it round and crushing it, as is exemplarily shown to have been done in FIG. 1, so that the vacant space 6 is made into a closed vacant space which is separated from the other open end 9 of the stainless steel pipe 1 by the alumina fiber bundle 2. At this time, therefore, the gas within the stainless steel pipe 1 and between the alumina fibers of the alumina fiber bundle 2 and within the vacant space 6 is substantially pure oxygen.

Next, this charged stainless steel tube 1 is plunged below the surface of a quantity 7 of molten pure magnesium which is at approximately 710° C. and which is contained in a molten metal container 4. The charged stainless steel tube 1 is kept in this submerged condition for about fifteen minutes, and then is removed from below the surface of the molten magnesium 7 and is directionally cooled from its closed end 3 towards its open end 9 by using cooling water, so as to solidify the molten pure magnesium which has entered into the space within said stainless steel tube 1 through its open end 9 and which has become infiltrated into the porous structure of the alumina fiber bundle 2.

Finally, the stainless steel tube 1 is removed by machining or the like from around the alumina fiber bundle 2, which has become thoroughly infiltrated with the magnesium metal to form a cylinder of composite alumina fiber/magnesium material. It is found, in the first preferred embodiment of the method according to the present invention described above, that substantially no voids exist between the fibers of this cylinder of composite alumina fiber/magnesium material, or in the lump of magnesium which has been solidified within the formerly void space 6 adjacent to the closed end 3 of the stainless steel tube 1. It is presumed that the oxygen which was originally present in these spaces, by combining with and oxidizing a small inconsiderable part of the molten magnesium matrix metal mass 7, has disappeared without leaving any substantial remnant (the small amount of magnesium oxide which is formed not substantially affecting the characteristics of the resulting composite alumina fiber/magnesium material), thus not impeding the good contacting together of the molten magnesium matrix metal and of the alumina fibers of the alumina fiber bundle 2. Thus the same functional effect is provided as was provided by the vacuum used in the prior art methods described above, i.e. it is prevented that atmospheric air trapped between the fibers of the alumina fiber bundle 2 should impede the infiltration of the molten magnesium matrix metal therebetween; and this effect is provided without the need for provision of any vacuum device. Further, it is presumed that the vacuum caused by the disappearance of the oxygen in the vacant space 6 is substantially helpful for drawing the molten matrix metal into and through the interstices of the alumina fiber bundle 2, because the alumina fiber bundle 2 is located between the vacant space 6 and the open end 9 of the stainless steel tube 1, and intercepts passage of molten matrix metal from said open end 9 to fill said vacant space 6. In this connection, it is advantageous for the orientation of the fibers of the alumina fiber bundle 2 to be generally along the central axis of the stainless steel tube 1, because according to this orientation the molten magnesium matrix metal can more freely flow along said central axis from said open end 9 of said stainless steel tube 1 towards said vacant space 6.

When a tensile test was performed upon such a piece of composite alumina fiber/magnesium material made in such a way as described above, at 0° fiber orientation, a tensile strength of 55 kg/mm$^2$ was recorded. This is quite comparable to the tensile strength of an alumina fiber/magnesium composite material which has been made by either of the above described inefficient conventional methods, i.e. the diffusion adhesion method or the autoclave method.

Further, as implemented above, it has been found that, because the combination of alumina fiber and molten magnesium has good wettability, it is not particularly necessary to apply any pressure to the surface of the molten mass 7 of magnesium metal, when the charged stainless steel tube 1 is submerged thereunder, in order to cause the molten magnesium to infiltrate into the porous structure of the alumina fiber bundle 2 under the influence of the suction created by the disappearance of the pure oxygen present in said porous structure, due to the combination of said oxygen with the molten magnesium matrix metal; atmospheric pressure is quite sufficient. This, again, provides a very great simplification in the apparatus over prior art methods, and makes for economy in production and ease of operation, using this first preferred embodiment of the method according to the present invention.

THE SECOND EMBODIMENT

Figure 2:
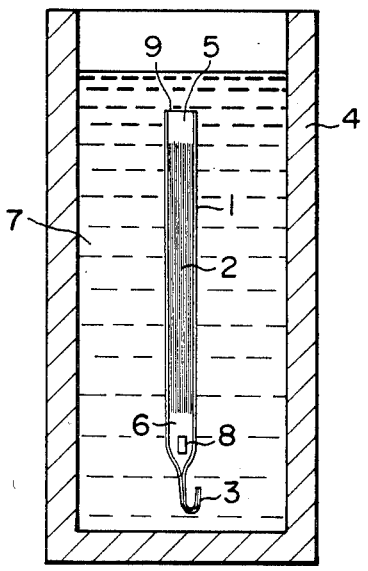
FIG. 2 is a sectional view, similar to FIG. 1, showing another casting mold filled with molten matrix metal, and another case filled with reinforcing material submerged in the molten matrix metal, during the practicing of a second preferred embodiment of the method according to the present invention - in this second preferred embodiment a piece of getter material being placed within this case, in a space formed between said reinforcing material charged therein and a closed end of said case.

In FIG. 2, there are shown the elements involved in the practicing of a second preferred embodiment of the method according to the present invention, in a fashion similar to FIG. 1. In FIG. 2, parts and spaces of the elements used in practicing this second preferred embodiment shown, which correspond to parts and spaces of elements used in the practice of the first preferred embodiment of the method according to the present invention shown in FIG. 1, and which have the same functions, are designated by the same reference numerals as in that figure. The production of fiber reinforced material, in this second preferred embodiment, is carried out as follows.

A tubular stainless steel pipe designated by the reference numeral 1, which initially is open at both ends, which is formed of stainless steel of JIS SUS310S, and which is 8 mm in diameter and 120 mm long, is charged with a bundle 2 of high strength type carbon fiber (which may be Torayca M40 type carbon fiber made by Toray Co. Ltd.) 80 mm long, the fibers of said carbon fiber bundle 2 being of fiber diameter 7 microns and all being aligned with substantially the same fiber orientation, in such a way that vacant spaces 5 and 6 within the stainless steel pipe 1 are left between its open ends and the bundle of carbon fiber 2. It should be noted that the vacant portion 6 is arranged to be somewhat larger than in the first preferred embodiment of the method according to the present invention whose practicing is shown in FIG. 1. The carbon fiber bundle 2 is squeezed by such an amount that its volume ratio is approximately 60%; i.e., so that the proportion of the total volume of the carbon fiber bundle 2 actually occupied by carbon fiber is approximately 60%, the rest of this volume being of course at this initial stage occupied by atmospheric air. Further, in the shown second preferred embodiment of the method according to the present invention, the orientation of the fibers of the carbon fiber bundle 2 is along the central axis of the stainless steel tube 1.

Next, oxygen is blown into one end of this charged stainless steel pipe 1, and gas is exhausted from the other end thereof. Thus, of course, initially the exhausted gas will be atmospheric air, and subsequently the exhausted gas will be a mixture of atmospheric air and oxygen; but, as the oxygen being blown in at said one end of the stainless steel pipe 1 progressively displaces the atmospheric air within the vacant spaces 5 and 6 at the opposite ends of the alumina fiber bundle 2, and percolates along between the carbon fibers of the alumina fiber bundle 2 and displaces the atmospheric air present therebetween, the gas which is exhausted from said other end of the stainless steel pipe 1 progressively to a greater and greater extent will become composed of pure oxygen. When this exhausted gas comes to be composed of substantially pure oxygen, i.e. when substantially all of the atmospheric air has been displaced from the vacant spaces 5 and 6 and more importantly substantially all of the atmospheric air has been displaced from between the carbon fibers of the alumina fiber bundle 2, then a getter piece 8 of pure magnesium of weight about 0.3 gm is inserted into the vacant space 6 at the one end 3 of the stainless steel tube 1, and this one end 3 of the stainless steel tube 1 is then sealed shut, for example by tightly turning it round and crushing it, as is exemplarily shown to have been done in FIG. 1, so that the vacant space 6 is made into a closed vacant space (containing the magnesium getter piece 8) which is separated from the other open end 9 of the stainless steel pipe 1 by the alumina fiber bundle 2. At this time, therefore, the gas within the stainless steel pipe 1 and between the carbon fibers of the alumina fiber bundle 2 and within the vacant space 6 is substantially pure oxygen.

Next, this charged stainless steel tube 1 is plunged below the surface of a quantity 7 of molten pure aluminum which is at approximately 800° C. and which is contained in a molten metal container 4. The charged stainless steel tube 1 is kept in this submerged condition for about ten minutes, and then the free surface of the molten pure aluminium mass 7 is pressurized to about 50 $kg/cm^2$ by using argon gas. This pressure condition is maintained for approximately another five minutes, and then the pressure is removed and the charged stainless steel tube 1 is removed from below the surface of the molten aluminium 7 and is directionally cooled from its closed end 3 towards its open end 9 by using cooling water, so as to solidify the molten pure aluminum which has entered into the space within said stainless steel tube 1 through its open end 9 and which has become infiltrated into the porous structure of the carbon fiber bundle 2.

Finally, the stainless steel tube 1 is removed by machining or the like from around the carbon fiber bundle 2, which has become thoroughly infiltrated with the aluminum metal to form a cylinder of composite carbon fiber/aluminum material. It is again found, in the second preferred embodiment of the method according to the present invention described above, that substantially no voids exist between the fibers of this cylinder of composite carbon fiber/aluminum material, or in the lump of aluminum which has been solidified within the formerly void space 6 adjacent to the closed end 3 of the stainless steel tube 1, which originally contained the magnesium getter piece 8, of which no visible trace remains. It is presumed that the oxygen which was originally present in these spaces, by combining with and oxidizing the magnesium getter piece 8, has disappeared without leaving any substantial remnant (the small amount of magnesium oxide which is formed having been dispersed within the lump of aluminum which has solidified within the space 6, and not substantially affecting the characteristics of the resulting composite carbon fiber/aluminium material), thus not impeding the good contacting together of the molten aluminum matrix metal and of the carbon fibers of the carbon fiber bundle 2. Thus the same functional effect is provided as was provided by the vacuum used in the prior art methods described above, i.e. it is prevented that atmospheric air trapped between the fibers of the carbon fiber bundle 2 should impede the infiltration of the molten aluminum matrix metal therebetween; and this effect is provided without the need for provision of any vacuum device. Further, it is again presumed that the vacuum caused by the disappearance of the oxygen in the vacant space 6 is substantially helpful for drawing the molten matrix metal into and through the interstices of the carbon fiber bundle 2, because the carbon fiber bundle 2 is located between the vacant space 2 and the open end 9 of the stainless steel tube 1, and intercepts passage of molten matrix metal from said open end 9 to fill said vacant space 6. In this connection, it is advantageous for the orientation of the fibers of the carbon fiber bundle 2 to be generally along the central axis of the stainless steel tube 1, because according to this orientation the molten aluminum matrix metal can more freely flow along said central axis, from said open end 9 of said stainless steel tube 1 towards said vacant space 6.

When a tensile test was performed upon such a piece of composite carbon fiber/aluminum material made in such a way as described above, at 0° fiber orientation, a tensile strength of 75 kg/mm$^2$ was recorded. This is quite comparable to the tensile strength of a carbon fiber/aluminum composite material which has been made by either of the above described inefficient conventional methods, i.e. the diffusion adhesion method or the autoclave method.

Because the wettability of the combination of carbon fiber and molten aluminum is not very good, it is necessary to apply a moderate pressure of 50 kg/cm$^2$ to the surface of the molten mass 7 of aluminum metal, when the charged stainless steel tube 1 is submerged thereunder, in order to aid the molten aluminum to infiltrate into the porous structure of the carbon fiber bundle 2 under the influence of the suction created by the disappearance of the pure oxygen present in said porous structure due to the combination of said oxygen with the magnesium getter piece 8; atmospheric pressure is not really sufficient. However, the pressure required is relatively low, and accordingly the pressurizing device required is not very expensive. This makes for economy in production and ease of operation, using the method according to this second preferred embodiment of the present invention.

THE THIRD EMBODIMENT

Now, a third preferred embodiment of the method according to the present invention will be described. No illustrative figure is particularly given for this third preferred embodiment, since the details of the structure of the elements used therein are quite the same as in the first preferred embodiment of the method according to the present invention shown in FIG. 1, and thus this figure may be referred to for understanding this third preferred embodiment also. Parts and spaces of the elements used in practicing this third preferred embodiment, which correspond to parts and spaces of elements used in the practice of the first and second preferred embodiments of the method according to the present invention shown in FIGS. 1 and 2, and which have the same functions, will be referred to in the following description by the same reference numerals as in those figures. The production of fiber reinforced material, in this third preferred embodiment, is carried out as follows.

A tubular stainless steel pipe 1, which initially is open at both ends, which is formed of stainless steel of JIS SUS310S, and which is 8 mm in diameter and 100 mm long, is charged with a bundle 2 of boron fiber (which may be boron fiber made by AVCO), 80 mm long, the fibers of said boron fiber bundle 2 being all aligned with substantially the same fiber orientation, in such a way that vacant spaces 5 and 6 within the stainless steel pipe 1 are left between its open ends and the bundle of boron fiber 2. The boron fiber bundle 2 is squeezed by such an amount that its volume ratio is approximately 60%; i.e., so that the proportion of the total volume of the boron fiber bundle 2 actually occupied by boron fiber is approximately 60%, the reset of this volume being of course at this initial stage occupied by atmospheric air. Further, in the shown third preferred embodiment of the method according to the present invention, the orientation of the fibers of the boron fiber bundle 2 is along the central axis of the stainless steel tube 1.

Next, again, oxygen is blown into one end of this charged stainless steel pipe 1, and gas is exhausted from the other end thereof. Thus, of course, initially the exhausted gas will be atmospheric air, and subsequently the exhausted gas will be a mixture of atmospheric air and oxygen; but, as the oxygen being blown in at said one end of the stainless steel pipe 1 progressively displaces the atmospheric air within the vacant spaces 5 and 6 at the opposite ends of the boron fiber bundle 2, and percolates along between the boron fibers of the boron fiber bundle 2 and displaces the atmospheric air present therebetween, the gas which is exhausted from said other end of the stainless steel pipe 1 progressively to a greater and greater extent will become composed of pure oxygen. When this exhausted gas comes to be composed of substantially pure oxygen, i.e. when substantially all of the atmospheric air has been displaced from the vacant spaces 5 and 6 and more importantly substantially all of the atmospheric air has been displaced from between the boron fibers of the boron fiber bundle 2, then one end 3 of the stainless steel tube 1 is sealed shut, for example by tightly turning it round and crushing it, so that the vacant space 6 is made into a closed vacant space which is separated from the other open end 9 of the stainless steel pipe 1 by the boron fiber bundle 2. At this time, therefore, the gas within the stainless steel pipe 1 and between the boron fibers of the boron fiber bundle 2 and within the vacant space 6 is substantially pure oxygen.

Next, this charged stainless steel tube 1 is plunged below the surface of a quantity 7 of molten pure magnesium which is at approximately 750° C. and which is contained in a molten metal container 4. The charged stainless steel tube 1 is kept in this submerged condition for about fifteen minutes, and then is removed from below the surface of the molten magnesium 7 and is directionally cooled from its closed end 3 towards its open end 9 by using cooling water, so as to solidify the molten pure magnesium which has entered into the space within said stainless steel tube 1 through its open end 9 and which has become infiltrated into the porous structure of the boron fiber bundle 2.

Finally, the stainless steel tube 1 is removed by machining or the like from around the boron fiber bundle 2, which has become thoroughly infiltrated with the magnesium metal to form a cylinder of composite boron fiber/magnesium material. It is found, in the third preferred embodiment of the method according to the present invention described above, that substantially no voids exist between the fibers of this cylinder of composite boron fiber/magnesium material, or in the lump of magnesium which has been solidified within the formerly void space 6 adjacent to the closed end 3 of the stainless steel tube 1. It is presumed that the oxygen which was originally present in these spaces, by combining with and oxidizing a small inconsiderable part of the molten magnesium matrix metal mass 7, has disappeared without leaving any substantial remnant (the small amount of magnesium oxide which is formed not substantially affecting the characteristics of the resulting composite boron fiber/magnesium material), thus not impeding the good contacting together of the molten magnesium matrix metal and of the boron fibers of the boron fiber bundle 2. Thus the same functional effect is provided as was provided by the vacuum used in the prior art methods described above, i.e. it is prevented that atmospheric air trapped between the fibers of the boron fiber bundle 2 should impede the infiltration of the molten magnesium matrix metal therebetween; and this effect is provided without the need for provision of any vacuum device. Further, it is presumed that the suction caused by the disappearance of the oxygen in the vacant space 6 is substantially helpful for sucking the molten matrix metal into and through the interstices of the boron fiber bundle 2, because the boron fiber bundle 2 is located between the vacant space 6 and the open end 9 of the stainless steel tube 1, and intercepts passage of molten matrix metal from said open end 9 to fill said vacant space 6. In this connection, it is again advantageous for the orientation of the fibers of the boron fiber bundle 2 to be generally along the central axis of the stainless steel tube 1, because according to this orientation the molten magnesium matrix metal can more freely flow along said central axis, from said open end 9 of said stainless steel tube 1 towards said vacant space 6.

When a tensile test was performed upon such a piece of composite boron fiber/magnesium material made in such a way as described above, at 0° fiber orientation, a tensile strength of 130 kg/mm$^2$ was recorded. This is quite comparable to the tensile strength of a boron fiber/magnesium composite material which has been made by either of the above described inefficient conventional methods, i.e. the diffusion adhesion method or the autoclave method.

Further, as implemented above, it has been found that, because the combination of boron fiber and molten magnesium has good wettability, it is not particularly necessary to apply any pressure to the surface of the molten mass 7 of magnesium metal, when the charged stainless steel tube 1 is submerged thereunder, in order to cause the molten magnesium to infiltrate into the porous structure of the boron fiber bundle 2 under the influence of the vacuum created by the disappearance of the pure oxygen present in said porous structure, due to the combination of said oxygen with the molten magnesium matrix metal; atmospheric pressure is quite sufficient. This, again, provides a very great simplification in the apparatus over prior art methods, and makes for economy in production and ease of operation, using this third preferred embodiment of the method according to the present invention.

THE FOURTH EMBODIMENT

Now, a fourth preferred embodiment of the method according to the present invention will be described. Again, no illustrative figure is particularly given for this fourth preferred embodiment, since the details of the structure of the elements used therein are again quite the same as in the first preferred embodiment of the method according to the present invention shown in FIG. 1, and thus this figure may be referred to for understanding this fourth preferred embodiment also. Parts and spaces of the elements used in practicing this fourth preferred embodiment, which correspond to parts and spaces of elements used in the practice of the first and second preferred embodiments of the method according to the present invention shown in FIGS. 1 and 2, and which have the same functions, will be referred to in the following description by the same reference numerals as in those figures. The production of fiber reinforced material, in this fourth preferred embodiment, is carried out as follows.

A tubular stainless steel pipe 1, which initially is open at both ends, which is formed of stainless steel of JIS SUS310S, and which is 8 mm in diameter and 100 mm long, is charged with a bundle 2 of carbon fiber (which may be Torayca M40 type carbon fiber made by Toray Co. Ltd.) 80 mm long, the fibers of said carbon fiber bundle 2 being of fiber diameter 7 microns and all being aligned with substantially the same fiber orientation, in such a way that vacant spaces 5 and 6 within the stainless steel pipe 1 are left between its open ends and the bundle of carbon fiber 2. The carbon fiber bundle 2 is squeezed by such an amount that its volume ratio is approximately 60%; i.e., so that the proportion of the total volume of the carbon fiber bundle 2 actually occupied by carbon fiber is approximately 60%, the rest of this volume being of course at this initial stage occupied by atmospheric air. Further, in the shown fourth preferred embodiment of the method according to the present invention, the orientation of the fibers of the carbon fiber bundle 2 is along the central axis of the stainless steel tube 1.

Next, again, oxygen is blown into one end of this charged stainless steel pipe 1, and gas is exhausted from the other end thereof. Thus, of course, initially the exhausted gas will be atmospheric air, and subsequently the exhausted gas will be a mixture of atmospheric air and oxygen; but, as the oxygen being blown in at said one end of the stainless steel pipe 1 progressively displaces the atmospheric air within the vacant spaces 5 and 6 at the opposite ends of the carbon fiber bundle 2, and percolates along between the carbon fibers of the carbon fiber bundle 2 and displaces the atmospheric air present therebetween, the gas which is exhausted from said other end of the stainless steel pipe 1 progressively to a greater and greater extent will become composed of pure oxygen. When this exhausted gas comes to be composed of substantially pure oxygen, i.e. when substantially all of the atmospheric air has been displaced from the vacant spaces 5 and 6 and more importantly substantially all of the atmospheric air has been displaced from between the carbon fibers of the carbon fiber bundle 2, then one end 3 of the stainless steel tube 1 is sealed shut, for example by tightly turning it round and crushing it, so that the vacant space 6 is made into a closed vacant space which is separated from the other open end 9 of the stainless steel pipe 1 by the carbon fiber bundle 2. At this time, therefore, the gas within the stainless steel pipe 1 and between the carbon fibers of the carbon fiber bundle 2 and within the vacant space 6 is substantially pure oxygen.

Next, this charged stainless steel tube 1 is plunged below the surface of a quantity 7 of molten pure magnesium which is at approximately 750° C. and which is contained in a molten metal container 4. The charged stainless steel tube 1 is kept in this submerged condition for about fifteen minutes, and then is removed from below the surface of the molten magnesium 7 and is directionally cooled from its closed end 3 towards its open end 9 by using cooling water, so as to solidify the molten pure magnesium which has entered into the space within said stainless steel tube 1 through its open end 9 and which has become infiltrated into the porous structure of the carbon fiber bundle 2.

Finally, the stainless steel tube 1 is removed by machining or the like from around the carbon fiber bundle 2, which has become thoroughly infiltrated with the magnesium metal to form a cylinder of composite carbon fiber/magnesium material. It is found, in the fourth preferred embodiment of the method according to the present invention described above, that substantially no voids exist between the fibers of this cylinder of composite carbon fiber/magnesium material, or in the lump of magnesium which has been solidified within the formerly void space 6 adjacent to the closed end 3 of the stainless steel tube 1. It is presumed that the oxygen which was originally present in these spaces, by combining with and oxidizing a small inconsiderable part of the molten magnesium matrix metal mass 7, has disappeared without leaving any substantial remnant (the small amount of magnesium oxide which is formed not substantially affecting the characteristics of the resulting composite carbon fiber/magnesium material), thus not impeding the good contacting together of the molten magnesium matrix metal and of the carbon fibers of the carbon fiber bundle 2. Thus the same functional effect is provided as was provided by the vacuum used in the prior art methods described above, i.e. it is prevented that atmospheric air trapped between the fibers of the carbon fiber bundle 2 should impede the infiltration of the molten magnesium matrix metal therebetween; and this effect is provided without the need for provision of any vacuum device. Further, it is again presumed that the vacuum caused by the disappearance of the oxygen in the vacant space 6 is substantially helpful for drawing the molten matrix metal into and through the interstices of the carbon fiber bundle 2, because the carbon fiber bundle 2 is located between the vacant space 6 and the open end 9 of the stainless steel tube 1, and intercepts passage of molten matrix metal from said open end 9 to fill said vacant space 6. In this connection, it is again advantageous for the orientation of the fibers of the carbon fiber bundle 2 to be generally along the central axis of the stainless steel tube 1, because according to this orientation the molten magnesium matrix metal can more freely flow along said central axis, from said open end 9 of said stainless steel tube 1 towards said vacant space 6.

When a tensile test was performed upon such a piece of composite carbon fiber/magnesium material made in such a way as described above, at 0° fiber orientation, a tensile strength of 80 kg/mm$^2$ was recorded. This is quite comparable to the tensile strength of a carbon fiber/magnesium composite material which has been made by either of the above described inefficient conventional methods, i.e. the diffusion adhesion method or the autoclave method.

Further, as implemented above, it has been found that, because the combination of carbon fiber and molten magnesium has good wettability, it is not particularly necessary to apply any pressure to the surface of the molten mass 7 of magnesium metal, when the charged stainless steel tube 1 is submerged thereunder, in order to cause the molten magnesium to infiltrate into the porous structure of the carbon fiber bundle 2 under the influence of the vacuum created by the disappearance of the pure oxygen present in said porous structure, due to the combination of said oxygen with the molten magnesium matrix metal; atmospheric pressure is quite sufficient. This, again, provides a very great simplification in the apparatus over prior art methods, and makes for economy in production and ease of operation, using this fourth preferred embodiment of the method according to the present invention.

CONCLUSION

Thus, as will be understood, according to the method of the present invention the composite material is produced without the use of any complicated, expensive, and cumbersome vacuum device. This means that composite material can be produced according to the present invention much more cheaply and efficiently than has been heretofore possible. Further, in the particular case where the matrix metal is magnesium, it has been heretofore rather difficult, even by the utilization of a complicated and costly vacuum device, to provide a good vacuum to ensure good contact between the molten magnesium matrix metal and the fibers to be embedded therein, because the molten magnesium has a relatively high vapor pressure, and accordingly any vacuum becomes filled with magnesium gas at this vapor pressure. However, according to the present invention, this difficulty of course is not present, because the removal of all gas between the fiber and the matrix metal is performed by an oxidizing reaction, not by vacuum pumping.

Further, in the case that the reinforcing material used is carbon fiber or boron fiber, it could be feared that this reinforcing material should become oxidized and degenerated when subjected to an oxidizing atmosphere at high temperature. In fact, however, according to the method of the present invention there is no risk of this, because all the oxygen present is removed by combination with a material (in the shown embodiments, magnesium) which has a high oxidizing tendency, higher than that of carbon or boron. Thus, there is no danger that the reinforcing fiber material should become deteriorated by oxygen reacting therewith, at least to such an extent as to seriously damage said reinforcing fiber material.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A method for making a composite material, comprising the steps, performed in the specified sequence, of:

(a) charging porous reinforcing material into a tubular member having two open opposite ends;

(b) replacing substantially all of the atmospheric air occupying the space in said tubular member including the interstices of said reinforcing material by substantially pure oxygen gas by blowing oxygen gas into said tubular member from one of said open ends thereof while exhausting the air in said space from the other of said open ends thereof;

(c) closing only one of said open ends of said tubular member while substantially maintaining the conditions obtained by step (b);

(d) submerging said tubular member charged with said reinforcing material and oxygen gas into a bath of molten metal, the molten metal thereby flowing into said tubular member through said one open end thereof and filling the space in said tubular member including the interstices of said reinforcing material as the oxygen gas which has been occupying said space in said tubular member including said interstices loses its volume by reacting with the molten metal; and (e) taking out said tubular member from said bath of molten metal and cooling it down to solidify the molten metal in said tubular member.

2. A method according to claim 1, wherein a getter element is placed into said tubular member from said one open end which is going to be closed just before the completion of step (c).

3. A method according to claim 1, wherein said reinforcing material comprises a multitude of fibers, the general orientation of said fibers being along the tubular member so as to extend between the two opposite ends thereof.

4. A method according to claim 3, wherein the cooling in step (e) is performed directionally from the closed end toward the open end of said tubular member.

5. A method according to claim 1, wherein step (d) is performed at substantially atmospheric pressure.

6. A method according to claim 1, wherein step (d) is performed at least partly at a pressure substantially higher than atmospheric pressure.

* * * * *